US009496605B2

(12) United States Patent
Tien et al.

(10) Patent No.: US 9,496,605 B2
(45) Date of Patent: Nov. 15, 2016

(54) TRANSMISSION DEVICE AND NEAR FIELD COMMUNICATION DEVICE USING THE SAME

(71) Applicant: Wistron NeWeb Corporation, Hsinchu (TW)

(72) Inventors: Mei Tien, Hsinchu (TW); Chih-Chun Peng, Hsinchu (TW); Liang-Kai Chen, Hsinchu (TW); Chin-Shih Lu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 168 days.

(21) Appl. No.: 14/034,545

(22) Filed: Sep. 23, 2013

(65) Prior Publication Data

US 2015/0029073 A1 Jan. 29, 2015

(30) Foreign Application Priority Data

Jul. 24, 2013 (TW) ..... 102126522 A

(51) Int. Cl.
*H01Q 1/50* (2006.01)
*H01Q 1/38* (2006.01)
*H01P 5/02* (2006.01)

(52) U.S. Cl.
CPC ..... *H01Q 1/50* (2013.01); *H01P 5/028* (2013.01); *H01Q 1/38* (2013.01)

(58) Field of Classification Search
CPC ..... H01P 3/00; H01P 3/02; H01P 3/026; H01P 3/08; H01P 3/081; H01P 3/10; H01P 5/028; H01Q 1/38; H01Q 1/2208; H01Q 1/2216; H01Q 1/2225; H01Q 1/2233; H01Q 1/2241; H01Q 1/2283; H01Q 1/50
USPC ..... 343/700 MS, 863, 905, 906
See application file for complete search history.

(56) References Cited

U.S. PATENT DOCUMENTS

| | | | | |
|---|---|---|---|---|
| 7,123,207 | B2 | 10/2006 | Yazdandoost | |
| 7,750,813 | B2 * | 7/2010 | Deavours | G06K 19/07749 340/572.7 |
| 8,653,975 | B2 * | 2/2014 | Deavours | 340/572.7 |
| 2006/0273976 | A1 | 12/2006 | Wang | |
| 2009/0144556 | A1 * | 6/2009 | Plet | G06F 21/34 713/185 |
| 2012/0256796 | A1 * | 10/2012 | Leiba | 343/702 |

FOREIGN PATENT DOCUMENTS

| | | | |
|---|---|---|---|
| CN | 202261415 | U | 5/2012 |
| EP | 2 337 147 | A1 | 6/2011 |
| TW | 507396 | B | 10/2002 |

* cited by examiner

*Primary Examiner* — Sue A Purvis
*Assistant Examiner* — Patrick Holecek
(74) *Attorney, Agent, or Firm* — Winston Hsu; Scott Margo

(57) ABSTRACT

A transmission device for a near field communication (NFC) device includes a matching circuit, a connecting interface with a first width for connecting an operating circuit of the NFC device, a first transmission line electrically connected between an antenna of the NFC device and the matching circuit, and a second transmission line electrically connected between connecting interface and the matching circuit, including an increasing width portion and a constant width portion, wherein a width of the second transmission increases from the first width to a second width within the increasing width portion and keeps the second width within the constant width portion, wherein the second width is greater than and related to the first width.

20 Claims, 8 Drawing Sheets

TRANSMISSION DEVICE AND NEAR FIELD COMMUNICATION DEVICE USING THE SAME

BACKGROUND OF THE INVENTION

1. Field of the Invention

The present invention relates to a transmission device and a near field communication device, and more particularly, to a transmission device and a near field communication device capable of reducing high-frequency signal transmission loss.

2. Description of the Prior Art

Near field communication (NFC) technology is a short-range high-frequency wireless communication technology, which enables the contactless data exchange between devices over approximately 20 cm distance in a frequency band of 13.56 Megahertz (MHz). As a result, the NFC technology has been widely used in various portable electronic devices (PED) so as to provide more convenient e-commerce service.

In general, an NFC device comprises three categories: an operating circuit (e.g., frequency modulation components, filter components, computing chips and memories), a matching circuit and an antenna, which connect through transmission lines. In other words, the operating circuit is electrically connected to the matching circuit through a transmission line, and the matching circuit is electrically connected to the antenna through another transmission line. The NFC technology is well known in the art. In short, the operating circuit processes high-frequency signals induced by the antenna or emits high-frequency signals via the antenna, and the matching circuit matches high-frequency signals transmitted between the operating circuit and the antenna to ensure the completeness of signal transmission. Although the NFC technology allows short-range wireless communication, the efficiency is rather low that high-frequency signal transmission loss commonly occurs, thereby limiting the communication range, the convenience and the applicability. Therefore, effectively reducing high-frequency signal transmission loss of the NFC device is a main and significant objective in the field.

SUMMARY OF THE INVENTION

It is therefore an objective of the present invention to provide a transmission device and a near field communication device so as to reduce high-frequency signal transmission loss.

An embodiment of the present invention discloses a transmission device for a near field communication (NFC) device. The transmission device includes a matching circuit, a connecting interface with a first width for connecting an operating circuit of the NFC device, a first transmission line electrically connected between an antenna of the NFC device and the matching circuit, and a second transmission line electrically connected between connecting interface and the matching circuit, including an increasing width portion and a constant width portion, wherein a width of the second transmission increases from the first width to a second width within the increasing width portion and keeps the second width within the constant width portion, wherein the second width is greater than and related to the first width.

An embodiment of the present invention also discloses a near field communication device. The near field communication device includes an operating circuit, an antenna and a transmission device. The transmission device is coupled between the operating circuit and the antenna for transmitting high-frequency signals outputted by the operating circuit to the antenna or transmitting high-frequency signals induced by the antenna to the operating circuit. The transmission device includes a matching circuit, a connecting interface with a first width for connecting the operating circuit of the NFC device, a first transmission line electrically connected between the antenna of the NFC device and the matching circuit, and a second transmission line electrically connected between connecting interface and the matching circuit, including an increasing width portion and a constant width portion, wherein a width of the second transmission increases from the first width to a second width within the increasing width portion and keeps the second width within the constant width portion, wherein the second width is greater than and related to the first width.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
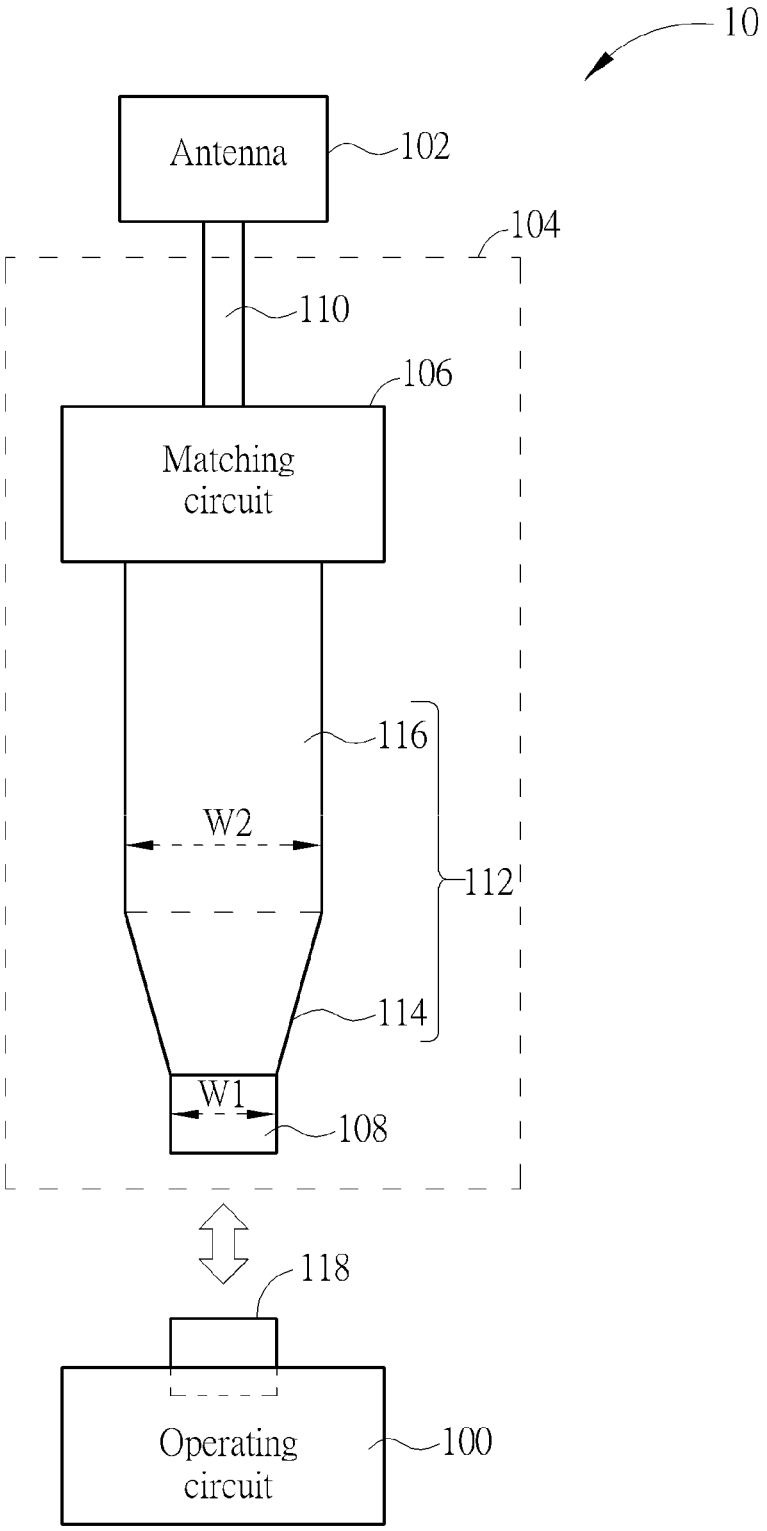
FIG. 1 is a schematic diagram illustrating a near field communication device according to an embodiment of the present invention.

Please refer to FIG. 1. FIG. 1 is a schematic diagram illustrating a near field communication (NFC) device 10 according to an embodiment of the present invention. The NFC device 10 comprises an operating circuit 100, an antenna 102 and a transmission device 104, so as to perform short-range high-frequency wireless communication. The operating circuit 100 processes high-frequency signals induced by the antenna 102 or emits high-frequency signals via the antenna 102. The transmission device 104 is disposed between the operating circuit 100 and the antenna 102 for transmitting high-frequency signals outputted by the operating circuit 100 to the antenna 102 or transmitting high-frequency signals induced by the antenna 102 to the operating circuit 100. The transmission device 104 comprises a matching circuit 106, a connecting interface 108, a first transmission line 110 and a second transmission line 112. The first transmission line 110 is electrically connected between the antenna 102 and the matching circuit 106. The second transmission line 112 is electrically connected between the connecting interface 108 and the matching circuit 106. The matching circuit 106 may match or convert high-frequency signals transmitted by the first transmission line 110 and the second transmission line 112. In addition, the specification of the connecting interface 108 meets that of a signal interface 118 on the operating circuit 100. For example, if the signal interface 118 is a 3-pin golden finger slot (sometimes also referred to as gold finger slot), the connecting interface 108 would be the golden finger fitting the 3-pin golden finger slot. Accordingly, when the connecting interface 108 is plugged into or assembled along with the signal interface 118 in any manner, the operating circuit 100 exchanges signals through the transmission device 104 and the antenna 102, thereby accomplishing NFC operations. Moreover, with the first transmission line 110 and the second transmission line 112, the transmission device 104 may effectively reduce high-frequency signal transmission loss (or attenuation) between the operating circuit 100 and the antenna 102 so as to improve signal quality.

More specifically, an impedance of the first transmission line 110 matches an impedance of the antenna 102. Preferably, the impedance of the first transmission line 110 and that of the antenna 102 are consistent. As a result, the impedance of the joint between the first transmission line 110 and the antenna 102 is continuous in operating frequency band, thus reducing signal transmission loss. In addition, if the first transmission line 110 and the antenna 102 are made of microstrip lines or metal sheets of similar or the same thickness, the width of the first transmission line 110 may be equal to the width of the antenna 102, thereby matching the impedance and reducing manufacturing complexity.

On the other hand, as shown in FIG. 1, according to the variation of the width, the second transmission line 112 can be divided into an increasing width portion 114 and a constant width portion 116; that is to say, the width of the second transmission line 112 within the increasing width portion 114 increases from a first width W1 to a second width W2, while the width of the second transmission line 112 within the constant width portion 116 substantially maintains the second width W2. Moreover, the first width W1 equals the width of the connecting interface 108, and the second width W2 is greater than and related to the first width W1. In other words, the second transmission line 112 is wider than the connecting interface 108 so as to reduce impedance and noise, and further improve signal quality. It is worth noting that FIG. 1 only illustrates the concept of the present invention, and those skilled in the art might make appropriate modifications or alterations according to different design considerations and system requirements. For example, in FIG. 1, the first transmission line 110 and the second transmission line 112 represent the width variation or the connection relation among the antenna 102, the matching circuit 106 and the operating circuit 100; however, the first transmission line 110 and the second transmission line 112, in fact, may be respectively composed of a plurality of metal wires. For example, in an embodiment, the antenna 102 has two signal terminals, and the first transmission line 110 comprises two metal wires corresponding to the two signal terminals of the antenna 102 respectively, such that the matching circuit 106 can convert and transmit output signal from the operating circuit 100 to the antenna 102.

Figure 2:
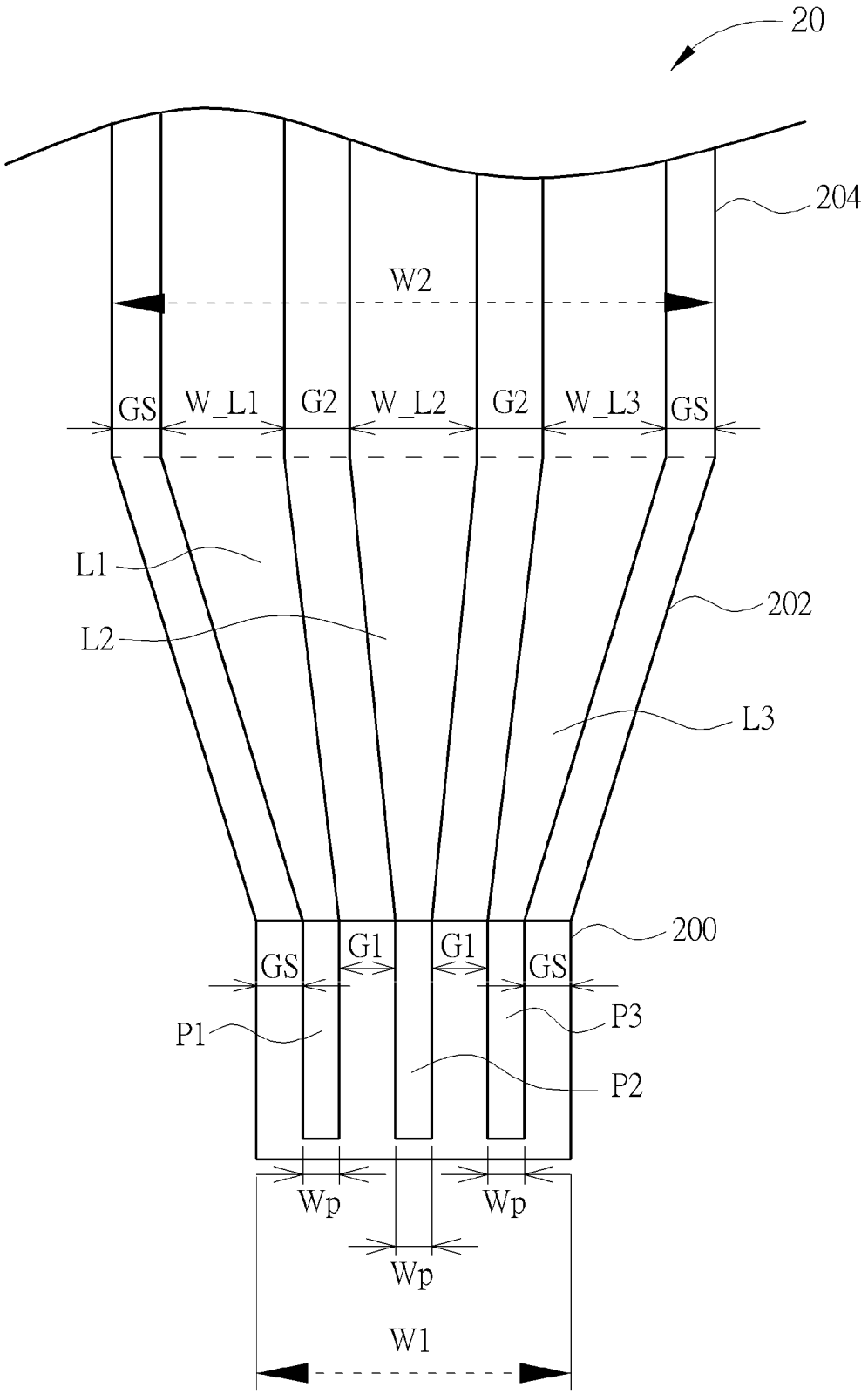
FIG. 2 is a schematic diagram illustrating a transmission line according to an embodiment of the present invention.

Furthermore, the number of the metal wires constituting the second transmission line 112 depends on the design of the matching circuit 106 and the operating circuit 100. For example, in an embodiment, the second transmission line 112 may comprise three metal wires, and the widths of the three metal wires may be modified appropriately according to the width of the connecting interface 108. For example, please refer to FIG. 2, which is a schematic diagram illustrating a transmission line 20 according to an embodiment of the present invention. The transmission line 20 can be employed as the second transmission line 112 shown in FIG. 1. The transmission line 20 comprises metal wires L1, L2, L3 and can be further divided into an increasing width portion 202 and a constant width portion 204. In this embodiment, a connecting interface 200 rests on the specification of the signal interface (i.e., the signal interface 118 of the operating circuit 100) and thus comprises pins P1, P2, P3. The width of each of the pins P1, P2, P3 is Wp, and any two of the adjacent pins are separated by a gap G1, so that the total width of the connecting interface 200 is the first width W1. The pins P1 and P3 are used to transmit differential output signals, and the pin P2 is used to be grounded. Moreover, as shown in FIG. 2, the widths of the metal wires L1, L2, L3 within the increasing width portion 202 respectively increase from Wp to W_L1, W_L2, W_L3, and the width of the gap between any two of the adjacent metal wires respectively increases from G1 to G2, so that the width of the transmission line 20 increases from W1 to W2. Within the constant width portion 204, the widths of the metal wires L1, L2, L3 substantially maintain W_L1, W_L2, W_L3, and the width of the gap between any two of the adjacent metal wires substantially maintains G2 so that the width of the transmission line 20 substantially maintains W2. The ratios of the widths W_L1, W_L2, W_L3 of the metal wires L1, L2, L3 to Wp and the ratio of the gap G2 to the gap G1 are listed in Table 1 below.

TABLE 1

| The widths of the metal wires L1, L2, L3 and the gap between any two of the metal wires L1, L2, L3 | The ratios to the widths and the gap of the pins P1, P2, P3 |
|---|---|
| W_L1 | (3.4 to 4.0) × Wp |
| W_L2 | (3.5 to 4.5) × Wp |
| W_L3 | (3.4 to 4.0) × Wp |
| G2 | (1.2 to 1.5) × G1 |

In other words, the widths W_L1 and W_L3 are respectively 3.4 to 4 times the width Wp. The width W_L2 is 3.5 to 4.5 times the width Wp. The gap G2 is 1.2 to 1.5 times the gap G1. Therefore, the second width W2 (substantially depending on the width W_L1, W_L2, W_L3 and the gap G2) is greater than and related to the first width W1 (substantially depending on the width Wp and the gap G1). In addition, as set forth above, the width of the grounded metal wire L2 is wider so as to stabilize the grounding system and effectively reduce noise. It is worth noting that in this embodiment the first width W1 or the second width W2 further includes a gap GS of fixed width on each side. The gap GS may be in a range between 0.2 mm and 1 mm to protect the metal wires L1 and L3. However, in other embodiments, the gap GS may be removed according to different design considerations and system requirements, but not limited thereto.

Figure 3:
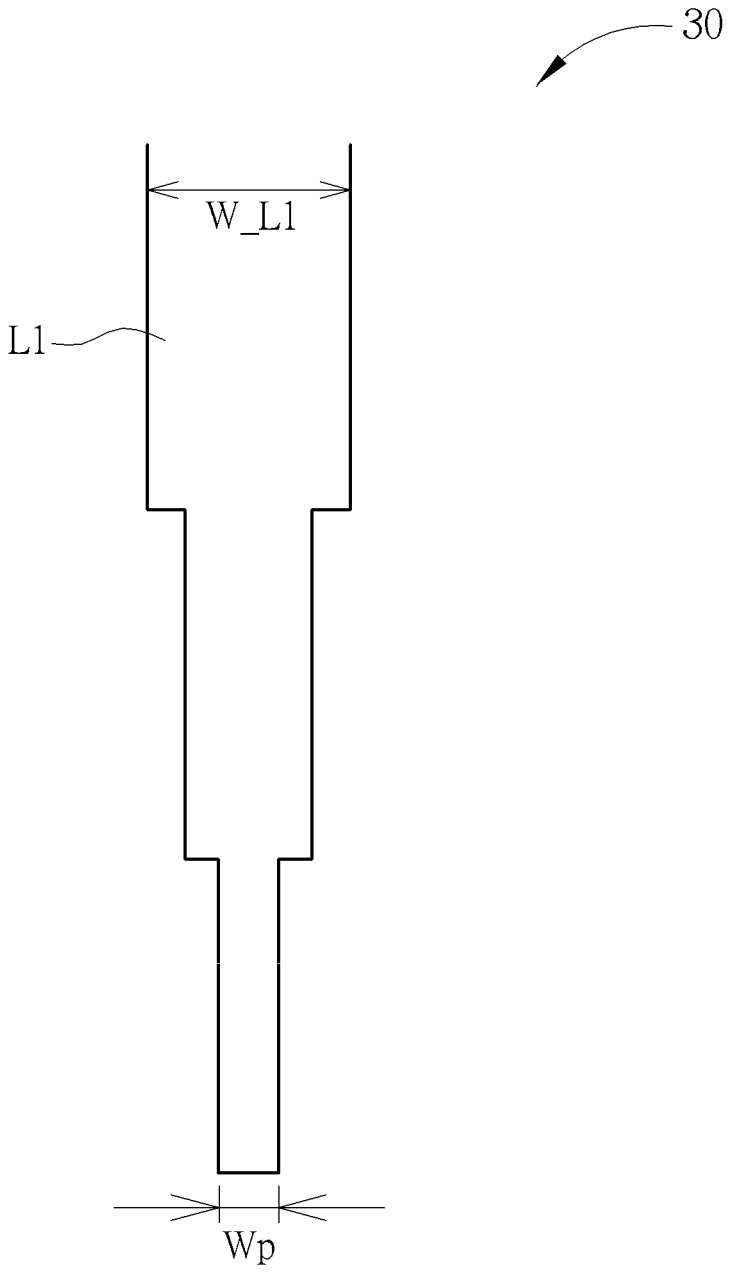
FIG. 3 is a schematic diagram illustrating a metal wire according to an embodiment of the present invention.

In FIG. 2, the widths of the metal wires L1, L2, L3 within the increasing width portion 202 respectively increase to W_L1, W_L2, W_L3 smoothly (i.e. in a linear manner). However, it is just one embodiment, and any potential structure with gradually increasing width can be employed as the increasing width portion 202. For example, FIG. 3 is a schematic diagram illustrating a metal wire 30 according to an embodiment of the present invention. The width of the metal wire 30 gradually increases from Wp to W_L1 by a plurality of steps; therefore, the metal wire 30 can replace the metal wire L1 shown in FIG. 2. By the same token, the metal wires L2 and L3 can be embodied as well, but the widths of the metal wires L2 and L3 increase from Wp to W_L2 and W_L3 respectively.

Figure 4:
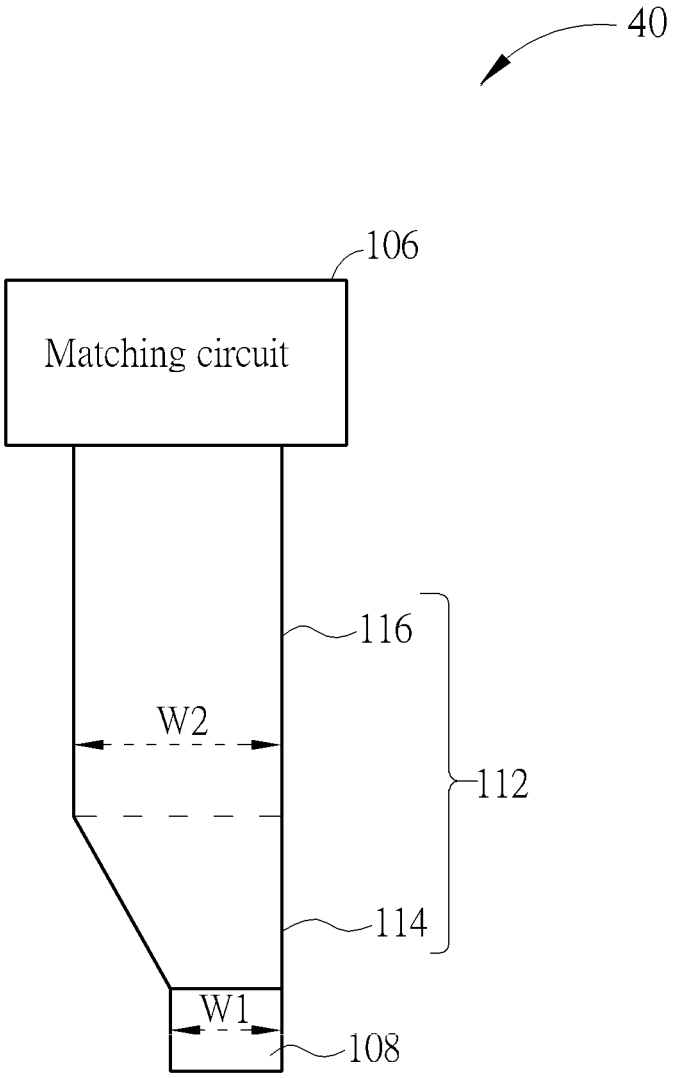
FIG. 4 is a schematic diagram illustrating a transmission line according to an embodiment of the present invention.

On the other hand, in FIG. 1 (or FIG. 2), the width of the second transmission line 112 (or the second transmission line 20) within the increasing width portion 114 (or the increasing width portion 202) increases symmetrically; i.e. both sides increase by exactly the same amount. However, the present invention is not limited thereto. For example, FIG. 4 is a schematic diagram illustrating a transmission line 40 according to an embodiment of the present invention. The width of the transmission line 40 increases toward the left side in FIG. 4; namely, the transmission line 40 stretches only to the left side, which is also suitable for the present invention.

Figure 5:
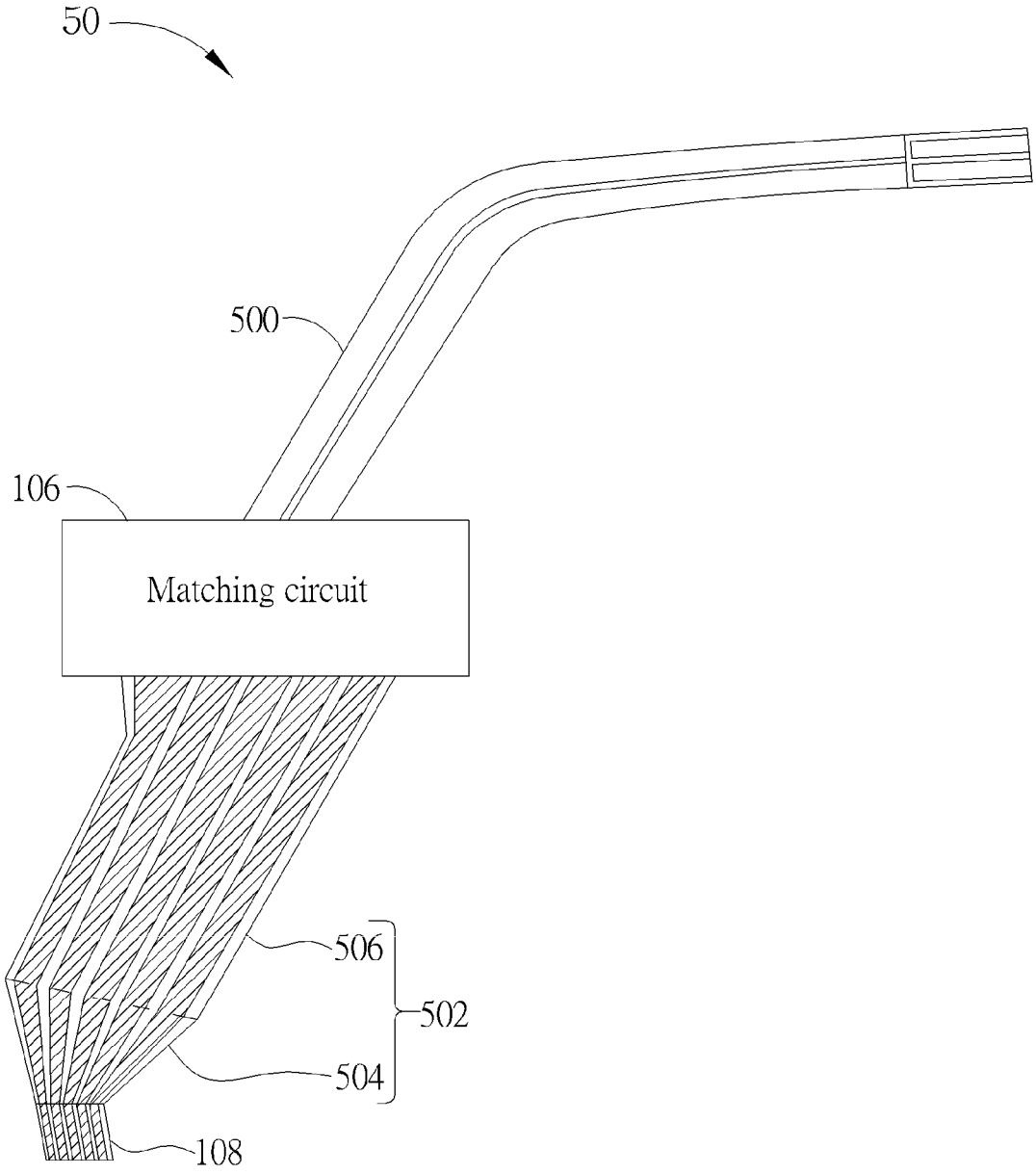
FIG. 5 is a schematic diagram illustrating a transmission device according to an embodiment of the present invention.

Furthermore, in FIG. 1, both the first transmission line 110 and the second transmission line 112 straight extend along a line direction, but not limited thereto. For example, FIG. 5 is a schematic diagram illustrating a transmission device 50 according to an embodiment of the present invention. Since the structure of the transmission device 50 is the same as that of the transmission device 104 in FIG. 1, the same numerals and notations denote the same components in the following description, and the similar parts are not detailed redundantly. As shown in FIG. 5, a first transmission line 500 and a second transmission line 502 of the transmission device 50 both comprise bends. Furthermore, the width of the second transmission line 502 within the increasing width portion 504 gradually increases, and the width of the second transmission line 502 within the constant width portion 506 substantially maintains fixed, which satisfy the requirements of the present invention as well. To match or adapt to the structure of the matching circuit 106, the width of a portion of the metal wires near the joint of the constant width portion 506 connecting the matching circuit 106 may vary while the width of the main portion of the metal wires substantially maintains fixed, which is still within the scope of the present invention. Apart from proper alterations and variations in shape, the material of the first transmission line 110 and the second transmission line 112 is not restricted. For example, the material of the first transmission line 110 and the second transmission line 112 may be flexible transmission lines, such as flexible printed circuit boards and flexible flat cables, or hard transmission lines, such as Flame Retardant 4 (FR4) and high-frequency circuit boards.

Figure 6:
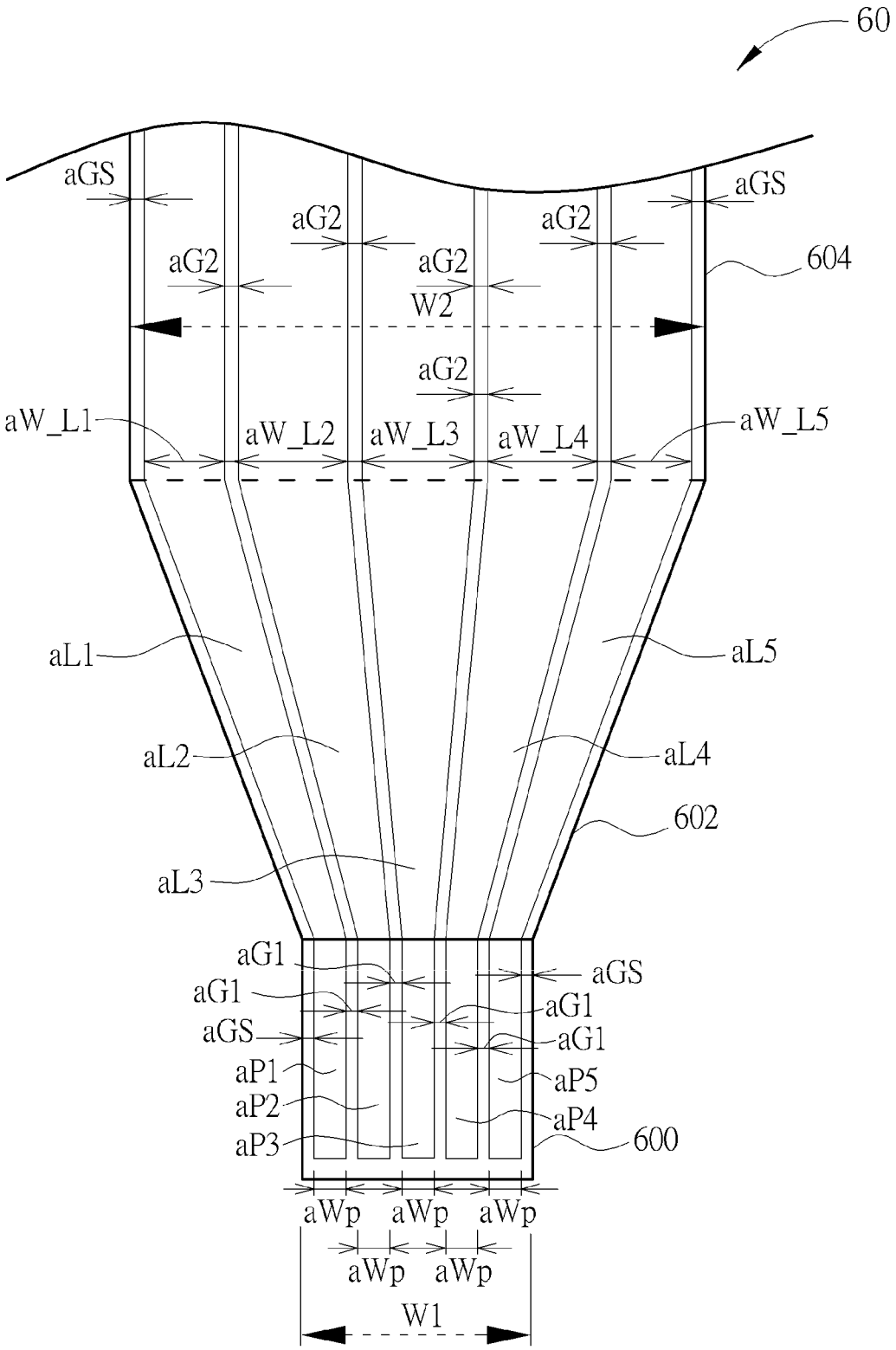
FIG. 6 is a schematic diagram illustrating a transmission line according to an embodiment of the present invention.

In addition, as set forth above, the number of the metal wires constituting the second transmission line 112 (or the second transmission line 502) depends on the design of the matching circuit 106 and the operating circuit 100 and is not limited to a specific number. For example, please refer to FIG. 6, which is a schematic diagram illustrating a transmission line 60 according to an embodiment of the present invention. The transmission line 60 can be employed as the second transmission line 112 shown in FIG. 1. The transmission line 60 comprises metal wires aL1-aL5, and can be further divided into an increasing width portion 602 and a constant width portion 604. In this embodiment, a connecting interface 600 rests on the specification of the signal interface (i.e., the signal interface 118 of the operating circuit 100) and thus comprises pins aP1-aP5. The width of each of the pins aP1-aP5 is aWp, and any two of the adjacent pins are separated by a gap aG1 so that the total width of the connecting interface 600 is the first width W1. The pins aP1 and aP5 are used to receive differential input signals, the pins aP2 and aP4 are used to transmit differential output signals, and the pin aP3 is used to be grounded. Moreover, as shown in FIG. 6, the widths of the metal wires aL1-aL5 within the increasing width portion 602 respectively increase from aWp to aW_L1-aW_L5, and the width of the gap between any two of the adjacent metal wires respectively increases from aG1 to aG2 so that the width of the transmission line 60 increases from W1 to W2. Within the constant width portion 604, the widths of the metal wires aL1-aL5 substantially maintain aW_L1-aW_L5, and the width of the gap between any two of the adjacent metal wires substantially maintains aG2 so that the width of the transmission line 60 substantially maintains W2. The ratios of the widths aW_L1-aW_L5 of the metal wires aL1-aL5 to aWp and the ratio of the gap aG2 to the gap aG1 are listed in Table 2 below.

TABLE 2

| The widths of the metal wires aL1-aL5 and the gap between any two of the metal wires aL1-aL5 | The ratios to the widths and the gap of the pins aP1-aP5 |
|---|---|
| aW_L1 | (2.5 to 3.0) × aWp |
| aW_L2 | (3.4 to 4.0) × aWp |
| aW_L3 | (3.5 to 4.5) × aWp |
| aW_L4 | (3.4 to 4.0) × aWp |
| aW_L5 | (2.5 to 3.0) × aWp |
| aG2 | (1.2 to 1.5) × aG1 |

In other words, the widths aW_L1 and aW_L5 are respectively 2.5 to 3.0 times the width aWp. The widths aW_L2 and aW_L4 are respectively 3.4 to 4.0 times the width aWp. The width aW_L3 is 3.5 to 4.5 times the width aWp. The gap aG2 is 1.2 to 1.5 times the gap aG1. Therefore, the second width W2 (substantially depending on the widths aW_L1-aW_L5 and the gap aG2) is greater than and related to the first width W1 (substantially depending on the width aWp and the gap aG1). It is worth noting that in this embodiment the first width W1 or the second width W2 further includes a gaps aGS of fixed width on each side, and the gap aGS can be modified according to different design considerations and system requirements, but not limited thereto.

Figure 7:
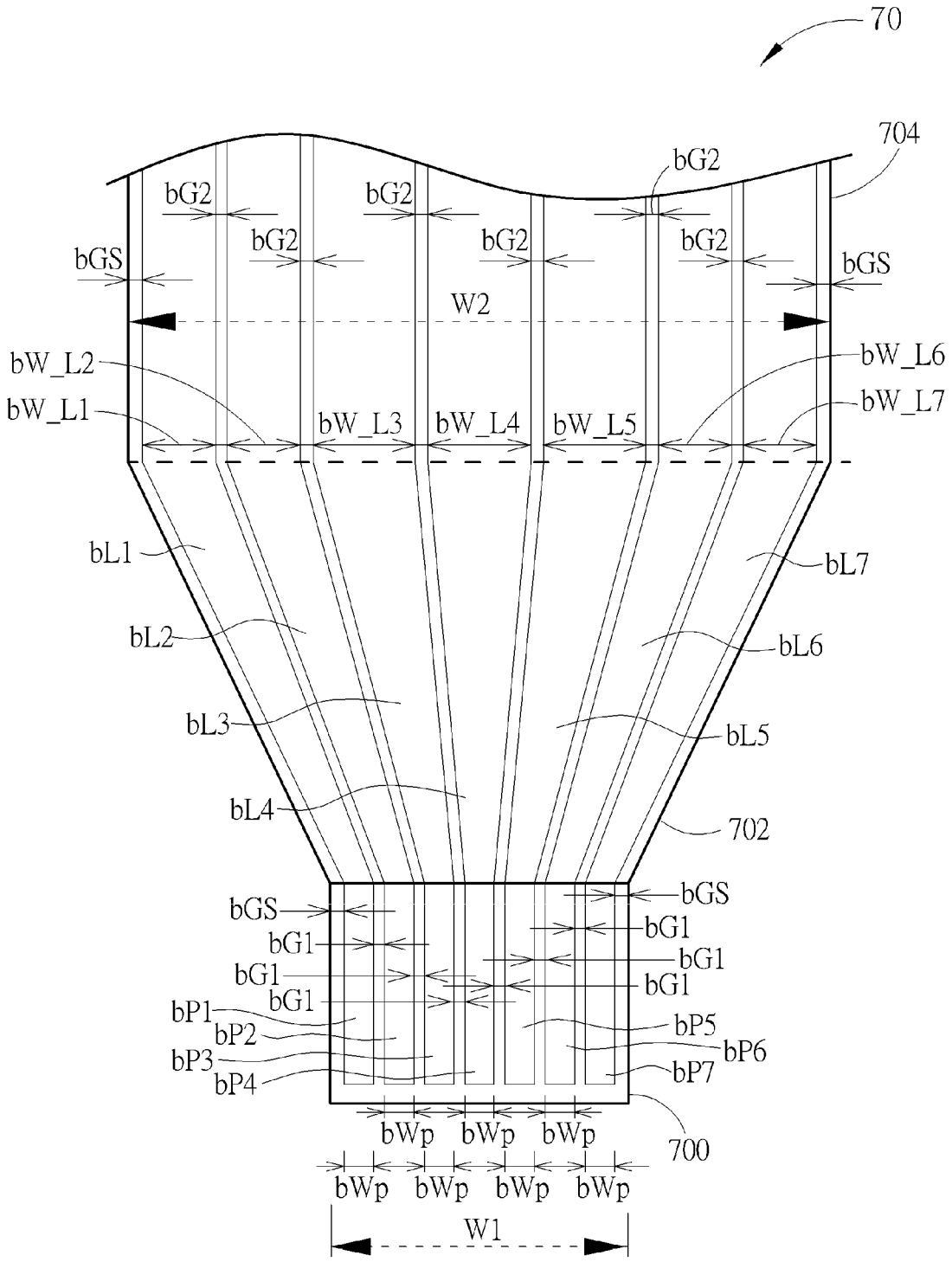
FIG. 7 is a schematic diagram illustrating a transmission line according to an embodiment of the present invention.

Similarly, please refer to FIG. 7, which is a schematic diagram illustrating a transmission line 70 according to an embodiment of the present invention. The transmission line 70 can be employed as the second transmission line 112 shown in FIG. 1. The transmission line 70 comprises metal wires bL1-bL7, and can be further divided into an increasing width portion 702 and a constant width portion 704. In this embodiment, a connecting interface 700 rests on the specification of the signal interface (i.e., the signal interface 118 of the operating circuit 100) and thus comprises pins bP1-bP7. The width of each of the pins bP1-bP7 is bWp, and any two of the adjacent pins are separated by a gap bG1 so that the total width of the connecting interface 700 is the first width W1. The pins bP1, bP2, bP6, bP7 are used to receive differential input signals, the pins bP3 and bP5 are used to transmit differential output signals, and the pin bP4 is used to be grounded. Moreover, as shown in FIG. 7, the widths of the metal wires bL1-bL7 within the increasing width portion 702 respectively increase from bWp to bW_L1-bW_L7, and the width of the gap between any two of the adjacent metal wires respectively increases from bG1 to bG2 so that the width of the transmission line 70 increases from W1 to W2. Within the constant width portion 704, the widths of the metal wires bL1-bL7 substantially maintain bW_L1-bW_L7, and the width of the gap between any two of the adjacent metal wires substantially maintains bG2 so that the width of the transmission line 70 substantially maintains W2. The ratios of the widths bW_L1-bW_L7 of the metal wires bL1-bL7 to bWp and the ratio of the gap bG2 to the gap bG1 are listed in Table 3 below.

TABLE 3

| The widths of the metal wires bL1-bL7 and the gap between any two of the metal wires bL1-bL7 | The ratios to the widths and the gap of the pins bP1-bP7 |
|---|---|
| bW_L1 | (2.5 to 3.0) × bWp |
| bW_L2 | (2.5 to 3.0) × bWp |
| bW_L3 | (3.4 to 4.0) × bWp |
| bW_L4 | (3.5 to 4.5) × bWp |
| bW_L5 | (3.4 to 4.0) × bWp |
| bW_L6 | (2.5 to 3.0) × bWp |
| bW_L7 | (2.5 to 3.0) × bWp |
| bG2 | (1.2 to 1.5) × bG1 |

In other words, the widths bW_L1, bW_L2, bW_L6, bW_L7 are respectively 2.5 to 3.0 times the width bWp. The widths bW_L3 and bW_L5 are respectively 3 to 4 times the width bWp. The width bW_L4 is 3.5 to 4.5 times the width bWp. The gap bG2 is 1.2 to 1.5 times the gap bG1. Therefore, the second width W2 (substantially depending on the widths bW_L1-bW_L7 and the gap bG2) is greater than and related to the first width W1 (substantially depending on the width bWp and the gap bG1). It is worth noting that in this embodiment the first width W1 or the second width W2 further includes a gaps bGS of fixed width on each side, and the gap bGS can be modified according to different design considerations and system requirements, but not limited thereto.

FIG. 6 and FIG. 7 respectively illustrate the configuration of the transmission line of 5 and 7 pins embodied in the present invention. The number of the metal wires and the manner that the width varies are just exemplified but not limited thereto, and those skilled in the art might appropriately modify, for example, the number of the metal wires, the manner that the width varies and the width ratio according to different design considerations and system requirements. Additionally, in order to promote design efficiency, the ground wires (e.g. the metal wire L2 in FIG. 2, the metal wire aL3 in FIG. 6 and the metal wire bL4 in FIG. 7) can be determined before the differential output signal wires (e.g. the metal wires L1 and L3 in FIG. 2, the metal wires aL2 and aL4 in FIG. 6 and the metal wires bL3 and bL5 in FIG. 7) when determining the widths and the width ratios of the metal wires. If there are differential input signal wires (e.g. the metal wires aL1 and aL5 in FIG. 6 and the metal wires bL1, bL2, bL6, bL7 in FIG. 7), the differential input signal wires can be determined subsequently.

Figure 8A:
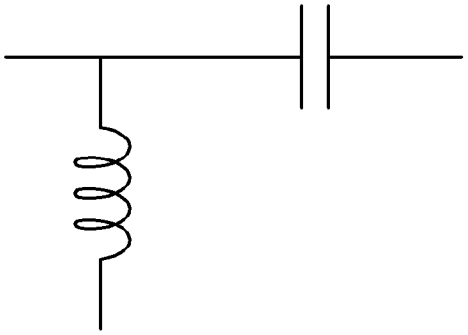
FIG. 8A is a schematic diagram illustrating an L-type high-pass matching circuit.
Figure 8B:
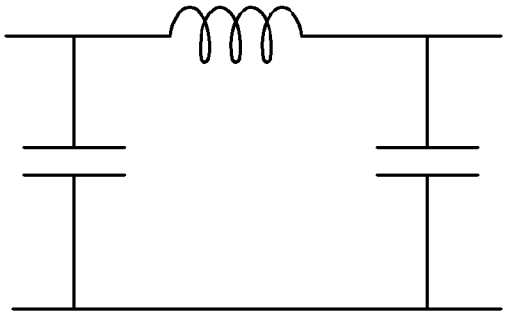
FIG. 8B is a schematic diagram illustrating a π-type low-pass matching circuit.
Figure 8C:
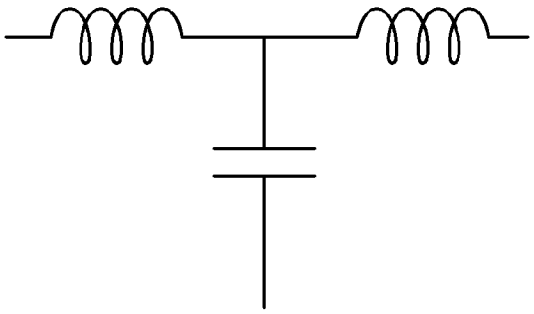
FIG. 8C is a schematic diagram illustrating a T-type low-pass matching circuit.
Figure 8D:
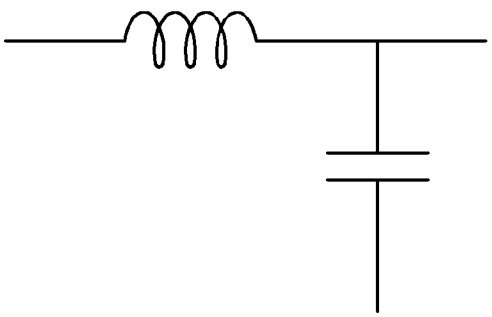
FIG. 8D is a schematic diagram illustrating an L-type low-pass matching circuit.

In addition, the matching circuit 106 is utilized to match or convert high-frequency signals and thus not restricted to certain type; therefore, those skilled in the art might make appropriate modifications or alterations according to different design considerations and system requirements. For example, FIG. 8A is a schematic diagram illustrating an L-type high-pass matching circuit adapted for the present invention. FIGS. 8B-8D are schematic diagrams illustrating a π-type, a T-type and an L-type low-pass matching circuits adapted for the present invention.

In the prior art, the transmission impedance of the NFC device is discontinuous and fails to reduce noise effectively, so high-frequency signal transmission loss commonly occurs. In comparison, since the impedance and the width of the transmission line are elaborately designed in the present invention, the impedance of the first transmission line and that of the antenna are consistent, and noise between the transmission device and the operating circuit is reduced, thereby decreasing high-frequency signal transmission loss to promote transmission efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A transmission device for a near field communication device, comprising:

a matching circuit;

a connecting interface with a first width, for connecting an operating circuit of the near field communication device, wherein the connecting interface comprises a plurality of detachable pins to take the connecting interface off the operating circuit;

a first transmission line, electrically connected between an antenna of the near field communication device and the matching circuit; and a second transmission line comprising a plurality of metal wires, electrically connected between the connecting interface and the matching circuit, comprising an increasing width portion and a constant width portion, wherein the first transmission line or the second transmission line is flexible, wherein one of the metal wires of the second transmission line is configured for grounding and has a width larger than widths of the other metal wires of the second transmission line, wherein a width of the second transmission line within the increasing width portion increases from the first width to a second width, a width of the second transmission line within the constant width portion substantially maintains the second width, and the second width is greater than and related to the first width.

2. The transmission device of claim 1, wherein an impedance of the first transmission line matches an impedance of the antenna.

3. The transmission device of claim 1, wherein the width of the second transmission line within the increasing width portion gradually increases from the first width to the second width by a plurality of steps.

4. The transmission device of claim 1, wherein the width of the second transmission line within the increasing width portion linearly increases from the first width to the second width.

5. The transmission device of claim 1, wherein a width of each of the pins substantially equals a third width.

6. The transmission device of claim 5, wherein the metal wires of the second transmission line correspond to the pins, and after a sum of widths of the metal wires increases from the first width to the second width within the increasing width portion, a plurality of ratios exist between the widths of the metal wires and the third width.

7. The transmission device of claim 6, wherein the ratios are related to functions of the pins.

8. The transmission device of claim 1, wherein the first transmission line or the second transmission line comprises at least one bend.

9. The transmission device of claim 1, wherein the constant width portion is electrically connected between the matching circuit and the increasing width portion, and further comprises width variation within a portion connecting the matching circuit for adapting to the matching circuit.

10. The transmission device of claim 1, wherein the matching circuit is selected from L-type, π-type and T-type matching circuits.

11. A near field communication device, comprising:

an operating circuit;

an antenna; and a transmission device, coupled between the operating circuit and the antenna, for transmitting signals outputted by the operating circuit to the antenna or transmitting signals induced by the antenna to the operating circuit, the transmission device comprising:

a matching circuit;

a connecting interface with a first width, for connecting the operating circuit, wherein the connecting interface comprises a plurality of detachable pins to take the connecting interface off the operating circuit;

a first transmission line, electrically connected between the antenna and the matching circuit; and a second transmission line comprising a plurality of metal wires, electrically connected between the connecting interface and the matching circuit, comprising an increasing width portion and a constant width portion, wherein the first transmission line or the second transmission line is flexible, wherein one of the metal wires of the second transmission lien is configured for grounding and has a width larger than widths of the other metal wires of the second transmission line, wherein a width of the second transmission line within the increasing width portion increases from the first width to a second width, a width of the second transmission line within the constant width portion substantially maintains the second width, and the second width is greater than and related to the first width.

12. The near field communication device of claim 11, wherein an impedance of the first transmission line matches an impedance of the antenna.

13. The near field communication device of claim 11, wherein the width of the second transmission line within the increasing width portion gradually increases from the first width to the second width by a plurality of steps.

14. The near field communication device of claim 11, wherein the width of the second transmission line within the increasing width portion linearly increases from the first width to the second width.

15. The near field communication device of claim 11, wherein a width of each of the pins substantially equals a third width.

16. The near field communication device of claim 15, wherein the metal wires of the second transmission line correspond to the pins, and after a sum of widths of the metal wires increases from the first width to the second width within the increasing width portion, a plurality of ratios exist between the widths of the metal wires and the third width.

17. The near field communication device of claim 16, wherein the ratios are related to functions of the pins.

18. The near field communication device of claim 11, wherein the first transmission line or the second transmission line comprises at least one bend.

19. The near field communication device of claim 11, wherein the constant width portion is electrically connected between the matching circuit and the increasing width portion, and further comprises width variation within a portion connecting the matching circuit for adapting to the matching circuit.

20. The near field communication device of claim 11, wherein the matching circuit is selected from L-type, π-type and T-type matching circuits.

* * * * *